US010087023B2

(12) United States Patent
Fujioka et al.

(10) Patent No.: US 10,087,023 B2
(45) Date of Patent: Oct. 2, 2018

(54) SHEET FEEDING APPARATUS AND IMAGE FORMING APPARATUS

(71) Applicant: Brother Kogyo Kabushiki Kaisha, Nagoya-shi, Aichi-ken (JP)

(72) Inventors: Michio Fujioka, Nagoya (JP); Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,710

(22) Filed: Sep. 27, 2017

(65) Prior Publication Data

US 2018/0088510 A1 Mar. 29, 2018

(30) Foreign Application Priority Data

Sep. 29, 2016 (JP) ..... 2016-192246

(51) Int. Cl.
*B65H 3/06* (2006.01)

(52) U.S. Cl.
CPC ..... *B65H 3/0684* (2013.01); *B65H 3/0669* (2013.01); *B65H 2403/40* (2013.01); *B65H 2403/512* (2013.01); *B65H 2403/60* (2013.01); *B65H 2404/1521* (2013.01); *B65H 2601/521* (2013.01)

(58) Field of Classification Search
CPC .... B65H 3/06; B65H 3/0684; B65H 2403/60; B65H 2404/1521; B65H 2601/521; B65H 3/0669
See application file for complete search history.

(56) References Cited

U.S. PATENT DOCUMENTS 7,731,176 B2 * 6/2010 Bato-On ..... B65H 3/0669 271/109
8,925,913 B2 * 1/2015 Kubo ..... B65H 3/0615 271/117

(Continued)

FOREIGN PATENT DOCUMENTS

JP S61-11640 U 1/1986
JP H1-321227 A 12/1989

(Continued)

*Primary Examiner* — Jeremy R Severson
(74) *Attorney, Agent, or Firm* — Banner & Witcoff, Ltd.

(57) ABSTRACT

A sheet feeding apparatus includes a feed roller, a roller holder supporting the feed roller rotatably about a rotation axis, a frame supporting the roller holder pivotably about a first axis parallel to the rotation axis of the feed roller, a force-transmitting device configured to transmit, to the roller holder, a force with which to cause the roller holder to pivot in a direction where the feed roller is pressed against a tray, a force-applying member movable between a force applying position where the force-applying member contacts the force-transmitting device to apply the force thereto and a force-free position where the force-applying member is spaced apart from the force-transmitting device, and a cushioning member configured to, when the force-applying member is at an initial contact positon located between the force applying position and the force-free position, be sandwiched in contact between the force-transmitting device and the force-applying member.

11 Claims, 11 Drawing Sheets

(56) References Cited

U.S. PATENT DOCUMENTS

| | | | | |
|---|---|---|---|---|
| 9,004,481 | B2 * | 4/2015 | Mimura | B65H 29/14 270/58.11 |
| 9,221,634 | B2 * | 12/2015 | Tanaka | B65H 3/0669 |
| 9,254,974 | B2 * | 2/2016 | Song | B65H 3/0669 |
| 2004/0245704 | A1 * | 12/2004 | Hall | B65H 5/06 271/117 |

FOREIGN PATENT DOCUMENTS

| | | | |
|---|---|---|---|
| JP | H4-153133 | A | 5/1992 |
| JP | H5-162870 | A | 6/1993 |
| JP | H7-215497 | A | 8/1995 |
| JP | H8-295427 | A | 11/1996 |
| JP | H9-202465 | A | 8/1997 |
| JP | H10-218396 | A | 8/1998 |

* cited by examiner

SHEET FEEDING APPARATUS AND IMAGE FORMING APPARATUS

CROSS-REFERENCE TO RELATED APPLICATION

This application claims priority from Japanese Patent Application No. 2016-192246 filed on Sep. 29, 2016, the content of which is incorporated herein by reference in its entirety.

FIELD OF DISCLOSURE

Aspects of the disclosure relate to a sheet feeding apparatus and an image forming apparatus including the same.

BACKGROUND

A known image forming apparatus, e.g., a printer and a copier, includes a sheet feed tray, an ejection tray, and an image forming device disposed in a conveying path extending from the sheet feed tray to the ejection tray. The image forming device forms an image on a sheet being conveyed from the sheet feed tray toward the ejection tray.

A roller unit is disposed above the sheet feed tray. The roller unit includes a feed roller (or a pickup roller), a separation roller, and a frame holding the feed roller and the separation roller rotatably. The frame is connected to a pivotable arm. When the arm pivots, the roller unit pivots about an axis aligned with a rotation axis of the separation roller. Pivoting of the roller unit allows the feed roller to move vertically between a first position and a second position, which is higher than the first position.

Before a sheet is fed, the feed roller is located at the second position and a leading end portion of a sheet supported on the sheet feed tray is located under the feed roller. When the sheet is fed, the feed roller and the separation roller start to rotate. When the feed roller and the separation roller rotate, the arm pivots to allow the roller unit to pivot. When the roller unit pivots, the feed roller lowers from the second position to the first position and then returns from the first position to the second position. In lowering from the second position to the first position, the feed roller, which is rotating, is pressed against the sheet on the sheet feed tray, so that the sheet is fed from the sheet feed tray toward the conveying path.

SUMMARY

In the above configuration, however, collision noise may be caused by the feed roller against a sheet every time a sheet is fed.

Illustrative aspects of the disclosure provide a sheet feeding apparatus, which reduces the occurrence of collision noise when a sheet is fed, and an image forming apparatus including the same.

According to an aspect of the disclosure, a sheet feeding apparatus includes a feed roller, a roller holder, a frame, a force-transmitting device, a force-applying member, and a cushioning member. The roller holder supports the feed roller rotatably about a rotation axis. The frame supports the roller holder pivotably about a first axis parallel to the rotation axis of the feed roller. The force-transmitting device is configured to transmit, to the roller holder, a force with which to cause the roller holder to pivot in a direction where the feed roller is pressed against a tray for supporting a sheet. The force-applying member is movable between a force applying position where the force-applying member contacts the force-transmitting device to apply the force thereto and a force-free position where the force-applying member is spaced apart from the force-transmitting device. The cushioning member is configured to, when the force-applying member is at an initial contact positon located between the force applying position and the force-free position, be sandwiched in contact between the force-transmitting device and the force-applying member.

With this structure, when a sheet is supported on the tray, the feed roller is in contact with an upper surface of the sheet regardless whether the sheet is fed or not fed. Thus, there is little likelihood that the feed roller collides with the sheet when the sheet is fed, which reduces the occurrence of collision noise.

According to another aspect of the disclosure, an image forming apparatus includes a casing, a tray, a sheet feeder, and an image forming device. The tray is pivotable between a closed position where the tray extends along a side of the casing and an open position where the tray is away from the side of the casing and configured to support a sheet thereon. The sheet feeder is configured to feed a sheet from the tray toward inside the casing. The image forming device is disposed in the casing and configured to form an image on the sheet fed by the sheet feeder. The sheet feeder includes a feed roller, a roller holder, a frame, a force-transmitting device, a force-applying member, and a cushioning member. The roller holder supports the feed roller rotatably about a rotation axis. The frame supports the roller holder pivotably about a first axis parallel to the rotation axis of the feed roller. The force-transmitting device is configured to transmit, to the roller holder, a force with which to cause the roller holder to pivot in a direction where the feed roller is pressed against the tray. The force-applying member is movable between a force applying position where the force-applying member contacts the force-transmitting device to apply the force thereto and a force-free position where the force-applying member is spaced apart from the force-transmitting device. The cushioning member is configured to, when the force-applying member is at an initial contact positon located between the force applying position and the force-free position, be sandwiched in contact between the force-transmitting device and the force-applying member.

With this structure, effects similar to those brought about by the above-described sheet feeding apparatus can be appreciated.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

An embodiment of the disclosure will be described with reference to the following drawings.

<Structure of Multi-Function Peripheral>

Figure 1:
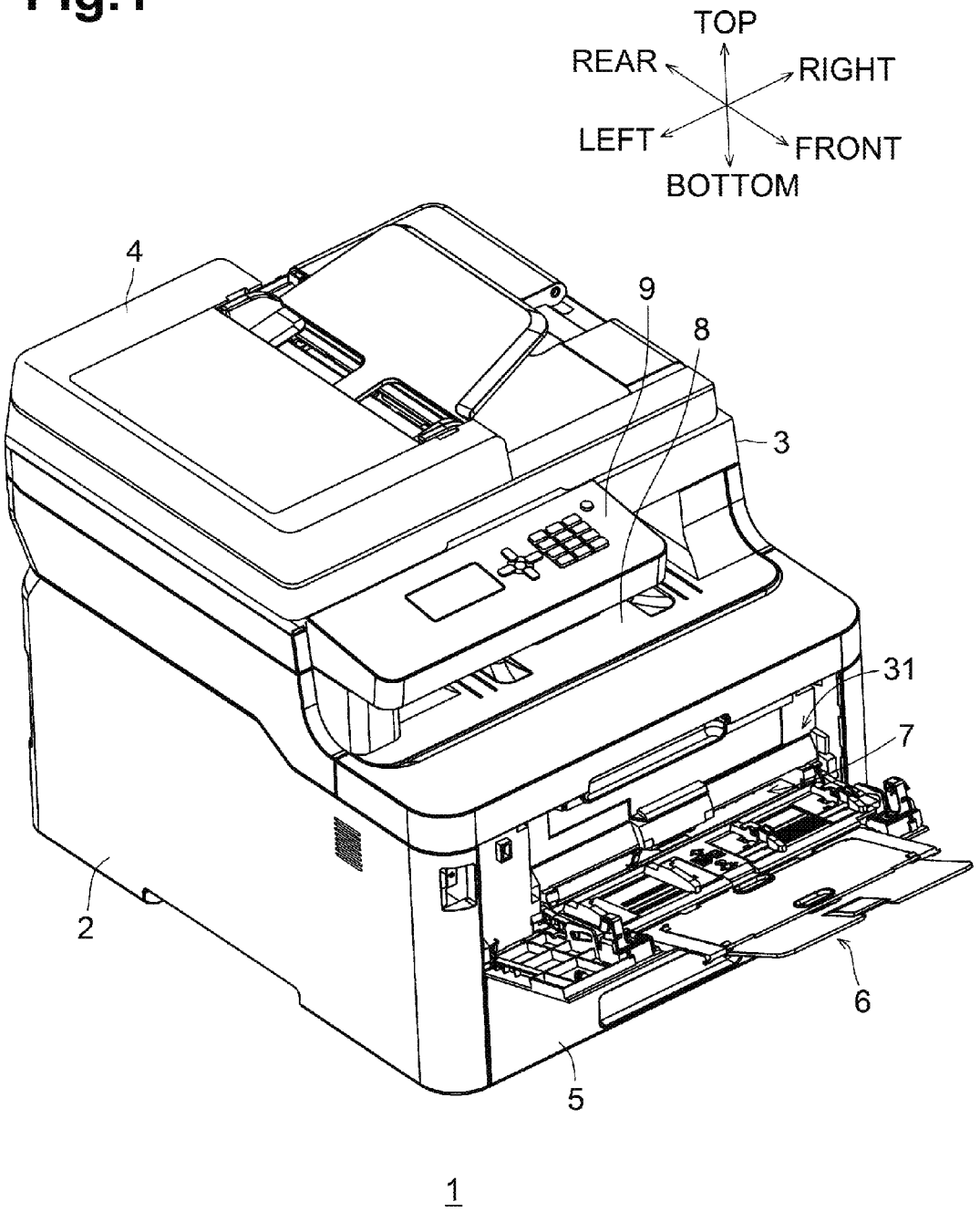
FIG. 1 is a perspective view of a multifunction peripheral (MFP) including a printer according to an illustrative embodiment.

As illustrated in FIG. 1, a multi-function peripheral (MFP) 1 includes a printer 2 as an example of an image forming apparatus, a scanner 3 and an auto document feeder (ADF) 4.

Figure 2:
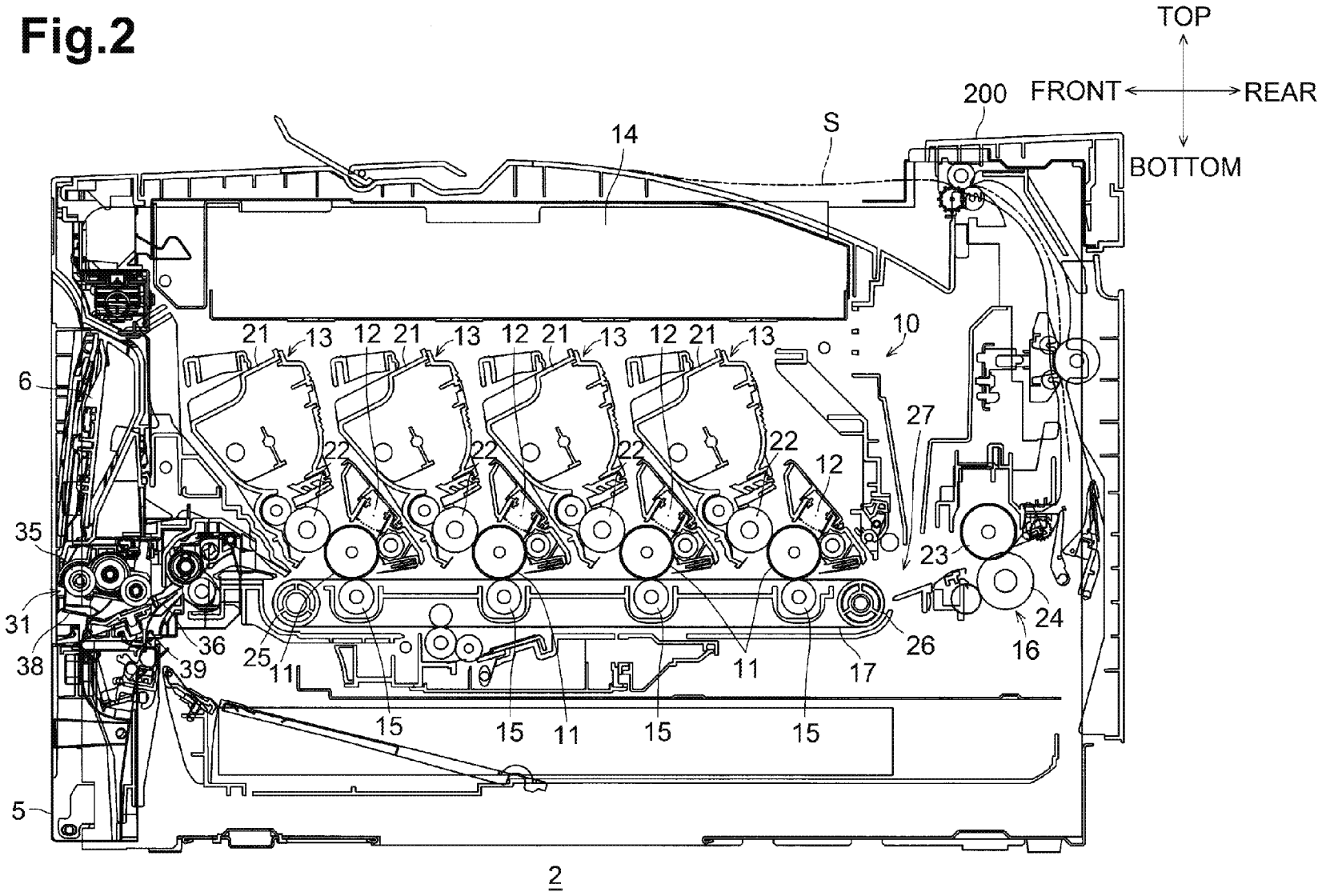
FIG. 2 is a sectional view of the printer.

As illustrated in FIG. 2, a sheet tray 5 is provided in a bottom portion of the printer 2. The sheet tray 5 is configured to support a stack of sheets.

A multi-purpose (MP) tray 6, as an example of a tray, is disposed at a front of the printer 2. The MP tray 6 is pivotable between a closed position where the MP tray 6 extends along the front of the printer 2, and an open position where the MP tray 6 is open relative to the front of the printer 2. The MP tray 6 is capable of supporting a stack of sheets S when it is open. When the MP tray 6 is open, a sheet-feed slot 7 provided at the front of the printer 2 is exposed. The sheet-feed slot 7 is used for feeding a sheet S on the MP tray 6 into the printer 2.

In the following description, a side of the MFP 1 where the MP tray 6 is provided refers to the front or front side, and its opposite side refers to the rear or rear side. The top or upper side, the bottom or lower side, the left or left side, and the right or right side are determined when the MFP 1 is viewed from the front side. In each drawing, the directions are indicated with arrows.

An ejection tray 8 is provided on an upper surface of the printer 2. Sheets supported on the sheet tray 5 or the MP tray 6 are fed one by one and conveyed through the printer 2 toward the ejection tray 8. While a sheet S is conveyed through the printer 2, an image is formed on the sheet S at an image forming device 10 (FIG. 2) accommodated in the printer 2. The sheet S having the image thereon is ejected to the ejection tray 8.

The scanner 3 is disposed above the printer 2 or spaced upward from an upper surface of the printer 2.

An operation panel 9 is provided at a front end portion of the scanner 3. The operation panel 9 includes a liquid crystal display and an assortment of operation buttons, such as a D-pad for selecting a key to be displayed on the display and a ten-key pad for inputting a number or character.

The ADF 4 is disposed above the scanner 3. Some sheets of documents can be set in the ADF 4. The documents set in the ADF 4 are fed singly and continuously to a contact glass (not shown) provided on an upper surface of the scanner 3 and returned to the ADF 4 after passing on the contact glass. While a document passes on the contact glass, an image of the document is scanned by an image sensor built in the scanner 3 and image data of the scanned image is generated.

<Internal Structure of Printer>

As illustrated in FIG. 2, the image forming device 10 is disposed inside a casing 200, which forms an outer shell of the printer 2. The image forming device 10 includes four photosensitive drums 11, four chargers 12, four developing devices 13, an exposing device 14, four transfer rollers 15, and a fixing device 16. A conveyor belt 17 is disposed in the casing 200.

The four photosensitive drums 11 are evenly spaced apart from one another in a front-rear direction and arranged in the order of colors, black (K), yellow (Y), magenta (M) and cyan (C), from front to rear. Each photosensitive drum 11 is rotatable about an axis extending in a left-right direction or width direction of the printer 2.

Each of the four chargers 12 is disposed diagonally above a corresponding one of the photosensitive drums 11 and is offset to the rear relative thereto. Each charger 12 is a scorotron-type charger including a wire or a grid.

Each of the four developing devices 13 is disposed diagonally above a corresponding one of the photosensitive drums 11 and is offset to the front relative thereto. Each developing device 13 includes a casing 21 and a developing roller 22 held by the casing 21. The developing roller 22 is rotatable about an axis extending in the left-right direction. The peripheral surface of the developing roller 22 is in contact with the peripheral surface of a corresponding photosensitive drum 11.

The exposing device 14 is disposed above the photosensitive drums 11, the chargers 12, and the developing devices 13. The exposing device 14 includes a laser beam source and an optical system including a polygon mirror, and is configured to irradiate the peripheral surfaces of the respective photosensitive drums 11 with laser beam as modulated based on image data.

The four transfer rollers 15 are disposed below the photosensitive drums 11, respectively. Each transfer roller 15 is rotatable about an axis extending in the width direction.

The fixing device 16 is disposed behind the rearmost photosensitive drum 11. The fixing device 16 includes a heat roller 23 and a pressure roller 24. The heat roller 23 is rotatable about an axis extending in the width direction. The pressure roller 24 is disposed below the heat roller 23 and is rotatable about an axis extending in the width direction. The peripheral surface of the heat roller 23 is in contact with the peripheral surface of the pressure roller 24.

The conveyor belt 17 is disposed below the four photosensitive drums 11. The conveyor belt 17 is an endless belt and looped around two rollers 25, 26, which are located at the same position vertically and spaced apart from each other in the front-rear direction. The conveyor belt 17 has upper and lower flat surface portions extending between the two rollers 25, 26 in the front-rear direction and the left-right direction. The upper flat surface portion extends between each of the four photosensitive drums 11 and a corresponding one of the four transfer rollers 15 and is in contact with the peripheral surfaces of the photosensitive drums 11 and the transfer rollers 15.

During printing (image formation) of a sheet S, the photosensitive drums 11 rotate counterclockwise viewed from the right side. FIG. 2 illustrates the image forming device 10 viewed from the right side. When the photosensitive drums 11 rotate, the surface of each photosensitive drum 11 is uniformly charged by a corresponding charger 12 and then selectively exposed to laser beam from the exposing device 14. This exposure selectively removes electrostatic charges from the surface of the photosensitive drum 11 to form an electrostatic latent image on the surface of the photosensitive drum 11. A developing bias is applied to the developing rollers 22 of the respective developing devices 13. When an electrostatic latent image faces a developing roller 22, toner is supplied from the developing roller 22 to the electrostatic latent image due to a potential difference therebetween. This develops the electrostatic latent image on the surface of the photosensitive drum 11 into a toner image.

A single sheet S is supplied from the sheet tray 5 or the MP tray 6 (FIG. 1) to a conveying path 27 defined in the casing 200 of the printer 2. The conveying path 27 is a space continuing from the upper flat surface portion of the conveyor belt 17, via between the heat roller 23 and the pressure roller 24 of the fixing device 16, to the ejection tray 8 (FIG. 1). A sheet S to be conveyed through the conveying path 27 is fed onto the conveyor belt 17. During image formation, the conveyor belt 17 rotates clockwise viewed from the right side. The sheet S fed onto the conveyor belt 17 moves together with the upper flat surface portion of the conveyor belt 17 and passes between each of the photosensitive drums 11 and the conveyor belt 17.

A transfer bias is applied to the transfer rollers 15. When a monochrome image is formed on the sheet S, the black photosensitive drum 11 carries a black toner image on its surface. The black toner image on the surface of the black photosensitive drum 11 is transferred to the sheet S conveyed on the conveyor belt 17 by the influence of the transfer bias. Thus, the monochrome image by the black toner is formed on the sheet S. When a color image is formed on the sheet S, two or more photosensitive drums 11 carry respective different color toner images on their surfaces. The different color toner images are successively transferred and overlaid one above another on the sheet S, which is conveyed by the conveyer belt 17, by the influence of the transfer bias. The toner images overlaid one above another on the sheet S form a color image.

The sheet S having the toner image is conveyed toward the fixing device 16. In the fixing device 16, the sheet S passes through between the heat roller 23 and the pressure roller 24. The toner image is fixed on the sheet S by heat and pressure. This completes image formation on the sheet S. The sheet S having the image thereon is ejected to the ejection tray 8 (FIG. 1).

<MP Sheet Feed Mechanism>

The printer 2 includes a multi-purpose (MP) sheet feed mechanism 31 as an example of a sheet feeding apparatus or a sheet feeder. The MP sheet feed mechanism 31 is configured to feed a sheet S from the MP tray 6 to the conveying path 27 (FIG. 2). The MP sheet feed mechanism 31 is disposed at a position where it is exposed when the MP tray 6 is open as illustrated in FIG. 1.

Figure 3:
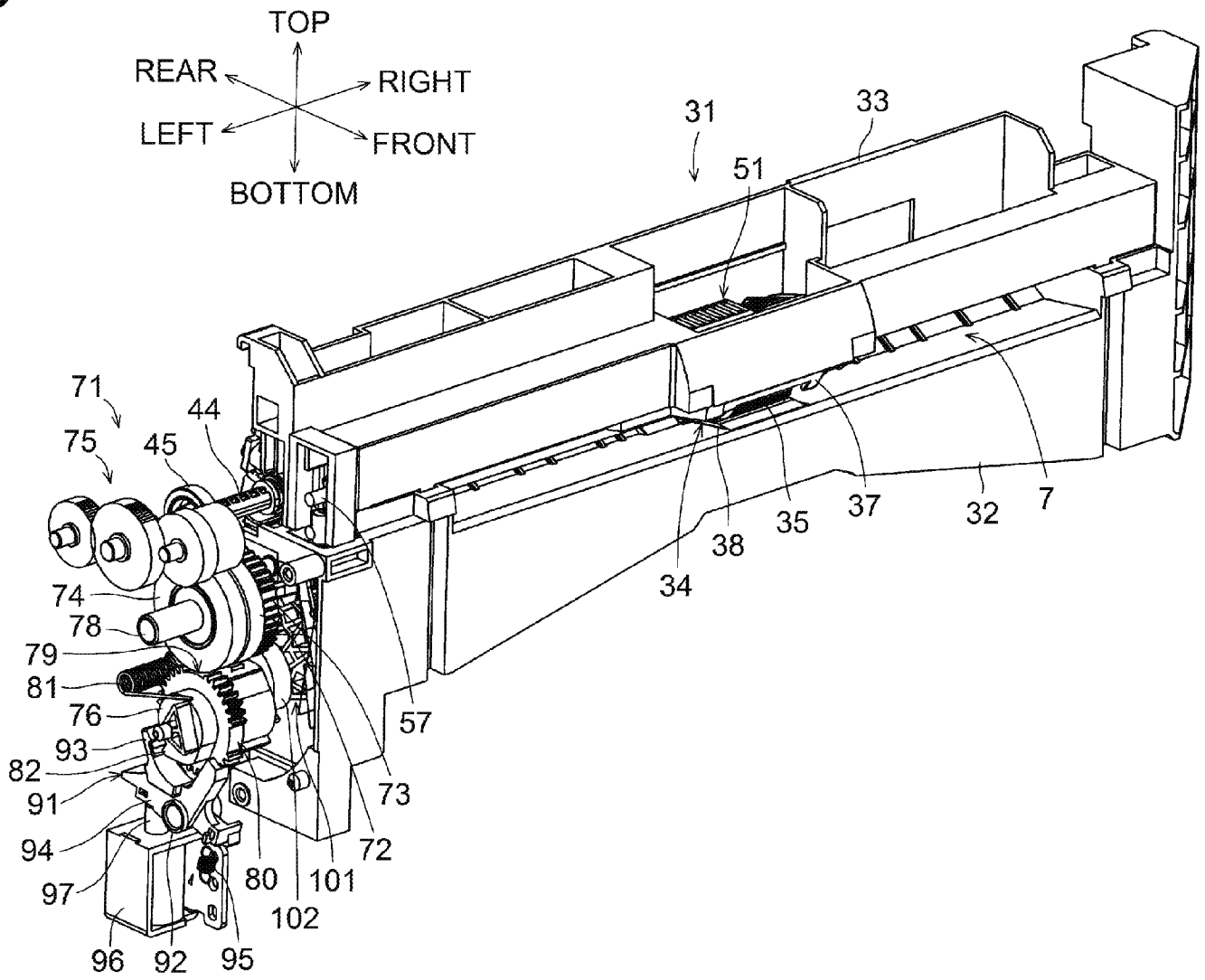
FIG. 3 is a perspective view of a multi-purpose (MP) sheet feed mechanism included in the laser printer.

As illustrated in FIG. 3, the MP sheet feed mechanism 31 includes a lower frame 32 extending in the left-right direction, and an upper frame 33, as an example of a frame, which is located above the lower frame 32 and extends in the left-right direction. The lower frame 32 and the upper frame 33 define therebetween a space elongated in the left-right direction. The space forms the sheet-feed slot 7 through which a sheet S is fed from the MP tray 6 toward the conveying path 27.

(1) Roller Unit

Figure 4:
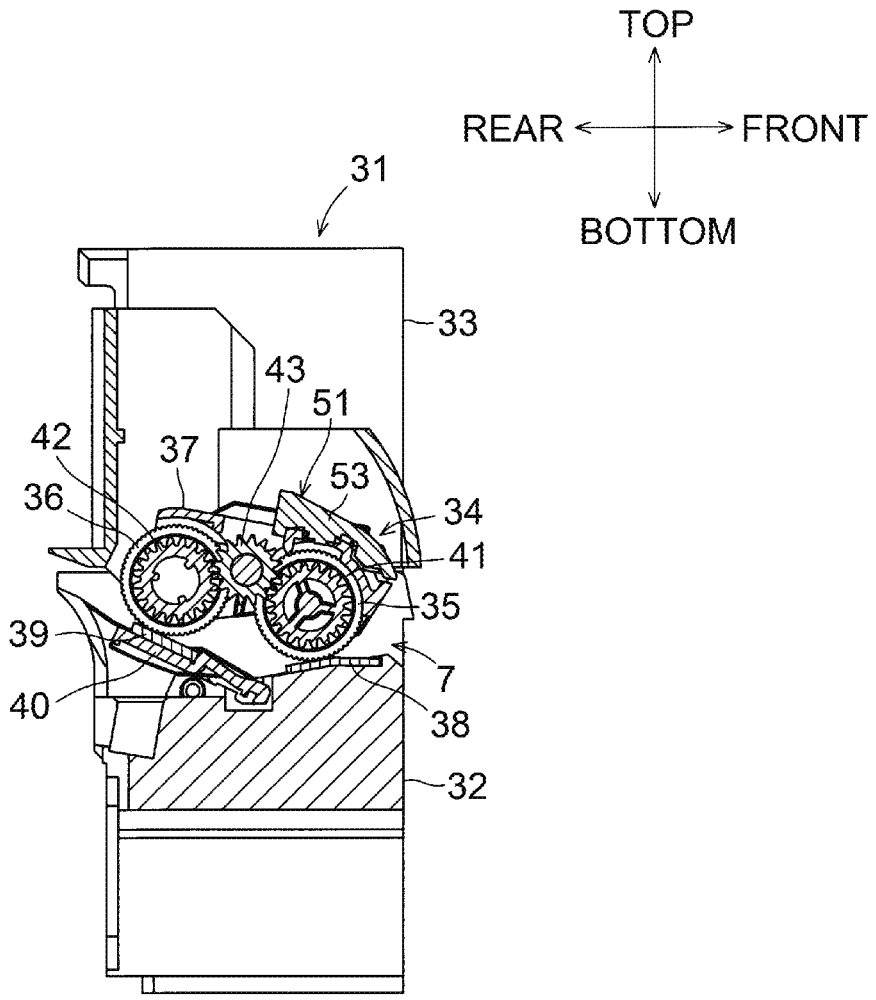
FIG. 4 is a sectional view of the MP sheet feed mechanism.

As illustrated in FIG. 4, a roller unit 34 is disposed between the lower frame 32 and the upper frame 33. The roller unit 34 includes a feed roller 35, a separation roller 36, and a roller holder 37. The feed roller 35 is disposed in front of the separation roller 36. The feed roller 35 and the separation roller 36 are supported by the roller holder 37 rotatably about their respective axes extending in the left-right direction.

A feed-roller pad 38 is disposed in a central portion, in the left-right direction, of a front end portion of an upper surface of the lower frame 32. The roller unit 34 is provided such that the feed roller 35 is capable of contacting the feed-roller pad 38 from above.

The front end portion of the upper surface of the lower frame 32 and the MP tray 6 constitute an example of a tray. A sheet S is supported on both of the front end portion of the upper surface of the lower frame 32 and the MP tray 6. Thus, a lower surface of a lowermost sheet S contacts the feed-roller pad 38 from above.

A separation pad 39 is disposed diagonally below the separation roller 36 and is offset to the rear relative to the separation roller 36. The separation pad 39 is held by the pad holder 40 cantilevered by the lower frame 32. The separation pad 39 is urged by an urging member, not illustrated, such as a coil spring, and thus is in elastic contact with a lower rear portion of the separation roller 36.

The feed roller 35 integrally includes a feed-roller gear 41 at a left end thereof, and the separation roller 36 integrally includes a separation-roller gear 42 at a left end thereof. The roller holder 37 supports an idle gear 43 rotatably. The idle gear 43 engages the feed-roller gear 41 and the separation-roller gear 42.

A drive shaft 44 illustrated in FIG. 3 extends in the left-right direction and is located to the left of the separation roller 36. The drive shaft 44 is coaxial with the separation roller 36. The drive shaft 44 is rotatably supported by the upper frame 33. A right end of the drive shaft 44 is connected to the separation-roller gear 42. A drive gear 45 is fixed at the left end of the drive shaft 44 and coaxial with the drive shaft 44.

(2) Pressing Mechanism

The MP sheet feed mechanism 31 includes a pressing mechanism 51. The pressing mechanism 51 is configured to press the roller unit 34 toward the MP tray 6. Specifically, the pressing mechanism 51 is configured to transmit a sheet feed pressure to the roller holder 37 and press the roller holder 37 in a direction where the feed roller 35 is pressed against the feed-roller pad 38. The sheet feed pressure is a force the feed roller 35 presses the sheet.

Figure 5:
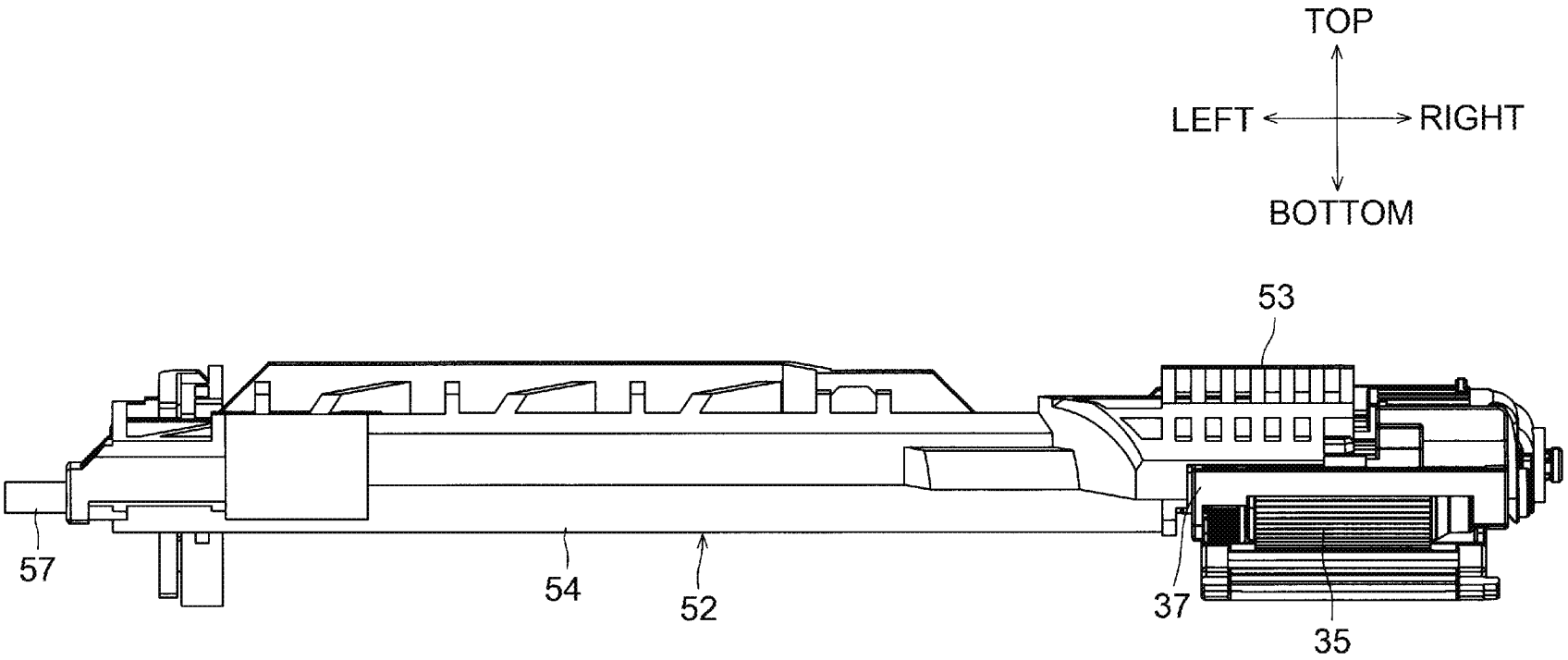
FIG. 5 is a perspective view of a roller unit and a pressing mechanism, which are included in the MP sheet feed mechanism.

The pressing mechanism 51 includes an arm 52 illustrated in FIG. 5. The arm 52 integrally includes a contact portion 53, an extending portion 54, and an input portion 57. The contact portion 53 contacts the front end portion of the roller holder 37 from above. The extending portion 54 extends from the contact portion 53 to the left. The input portion 57 extends from the left end portion of the extending portion 54 to the left.

The contact portion 53 is fixed to the roller holder 37.

The extending portion 54 is supported by the drive shaft 44 and is rotatable relative to the drive shaft 44. The drive shaft 44 is rotatably supported by the upper frame 33 and the contact portion 53 is fixed to the roller holder 37. The roller holder 37 (or the roller unit 34) is supported by the upper frame 33 such that it is pivotable about the drive shaft 44. A sheet S or a stack of sheets S is supported on the MP tray 6 such that a leading end portion of the sheet S or the stack of sheets S is inserted into between the feed roller 35 and the feed-roller pad 38. The feed roller 35 is raised to a height in relation to an amount (or the number) of sheets S inserted between the feed roller 35 and the feed-roller pad 38.

The input portion 57 is shaped like a cylinder. When projected onto a planar surface perpendicular to the left-right direction, the input portion 57 is located within a projection of the feed roller 35.

(3) Drive Mechanism

As illustrated in FIG. 3, a drive mechanism 71 is disposed to the left of the lower frame 32. The drive mechanism 71 includes, in addition to the drive gear 45, an output gear 72, a change gear 73, an input gear 74, a gear train 75, and a sector gear 76. The output gear 72 engages the drive gear 45. The change gear 73 is rotatable together with the output gear 72. The input gear 74 is coaxial with the output gear 72. The gear train 75 is configured to transmit a drive force from a motor (not illustrated) to the input gear 74. The sector gear 76 is configured to engage the input gear 74.

The output gear 72 is supported via a one-way clutch (not illustrated) by a gear shaft 78, which is rotatable together with the input gear 74.

Figure 6:
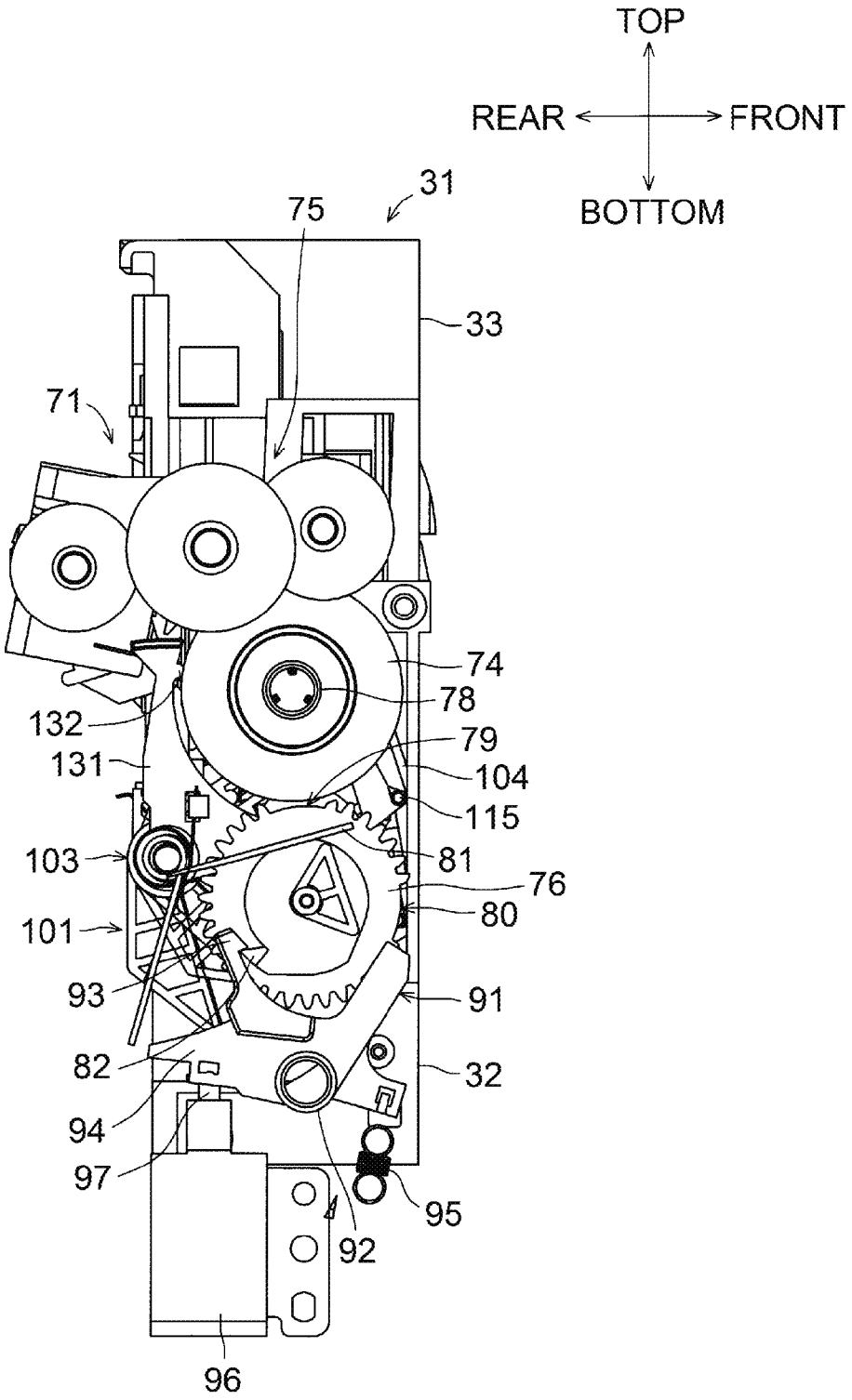
FIG. 6 is a left side view of a drive mechanism included in the MP sheet feed mechanism.

As illustrated in FIGS. 3 and 6, the sector gear 76 has a first missing teeth section 79 and a second missing teeth section 80, which are without teeth to engage the input gear 74 and separated from each other in the circumferential direction of the sector gear 76. The sector gear 76 is urged by a helical torsion spring 81 clockwise viewed from the left side. The left surface of the sector gear 76 is formed with an engaging portion 82 protruding to the left.

A first lock member 91 is disposed partially below the sector gear 76. The first lock member 91 integrally includes a shaft portion 92, a lock pawl 93, and an operation portion 94. The operation portion 94 extends to the rear from the shaft portion 92. The first lock member 91 is urged by a coil spring 95 clockwise viewed from the left side.

A solenoid 96 is disposed below the operation portion 94. The solenoid 96 has a plunger 97 facing upward. The plunger 97 is connected to the operation portion 94.

The position of the first lock member 91 with the solenoid 96 turned off is defined as a lock position. When the first lock member 91 is at the lock position, the lock pawl 93 is located within a ring-shaped area defined as a track of the engaging portion 82, which moves with the rotation of the sector gear 76. Thus, when the first lock member 91 is at the lock position, the lock pawl 93 is engageable with the engaging portion 82. When the lock pawl 93 engages the engaging portion 82, the sector gear 76 is restricted from rotating clockwise viewed from the left side.

When the solenoid 96 is turned on, the plunger 97 is drawn downward, and the first lock member 91 rotates about the shaft portion 92 counterclockwise viewed from the left side. With the counterclockwise rotation of the first lock member 91, the lock pawl 93 moves out of the ring-shaped area defined as the track of the engaging portion 82. When the solenoid 96 is turned on to off, the first lock member 91 rotates clockwise viewed from the left side by the urging force of the coil spring 95, and returns to the lock position.

<Force-Generating Mechanism>

Figure 7:
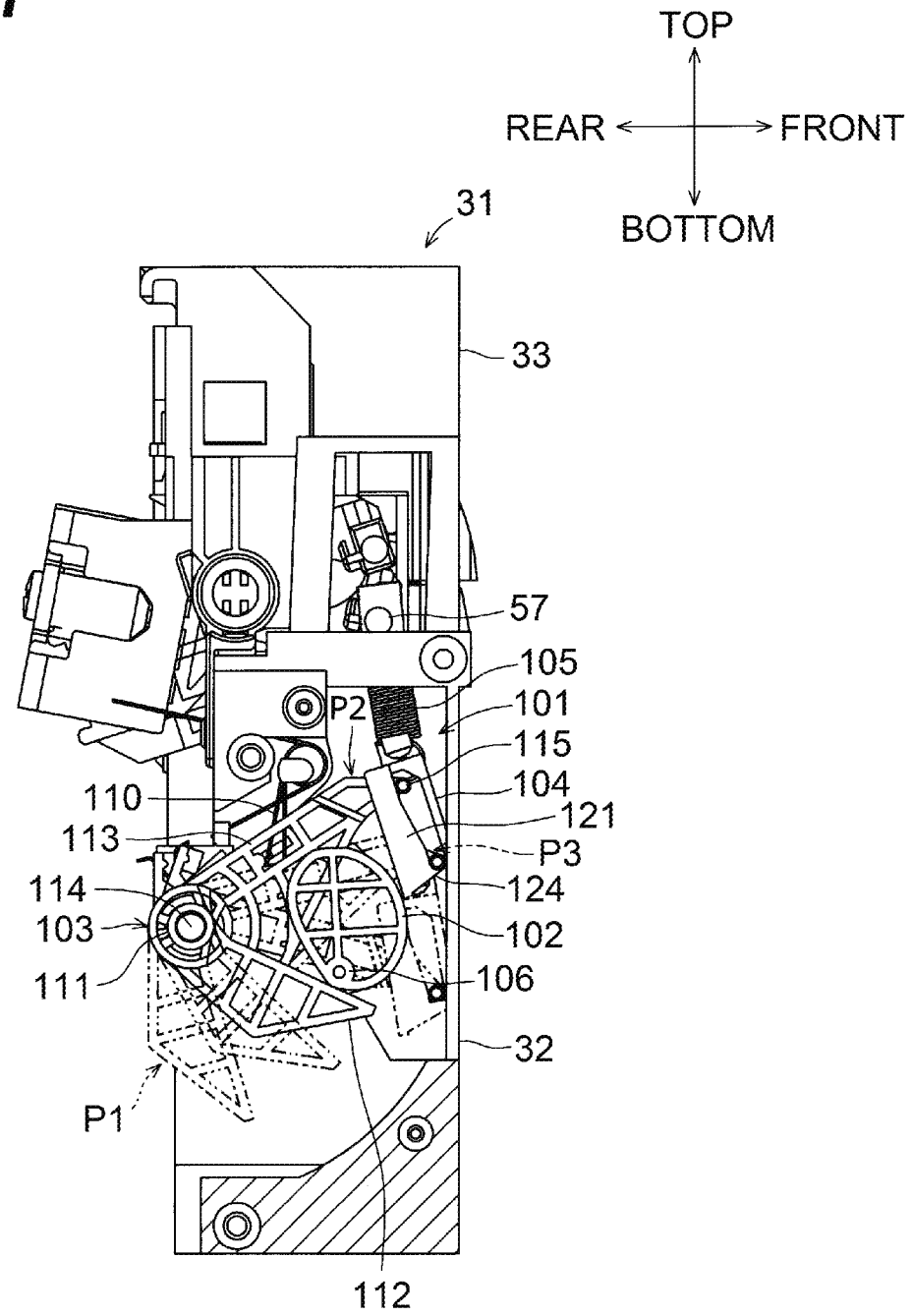
FIG. 7 is a sectional view of a force-generating mechanism included in the MP sheet feed mechanism.

The drive mechanism 71 includes a force-generating mechanism 101 illustrated in FIG. 7. The force-generating mechanism 101 includes a cam 102, a lever 103 as an example of a force-applying member, a force-releasing part 104 as an example of a force-transmitting device, and a force-transmission spring 105 as an example of force-transmitting device.

The cam 102 is fixed to a cam shaft 106, which is rotatable integrally with the sector gear 76 (FIG. 6).

The lever 103 is a resin molded part made from polyacetal (POM). The lever 103 includes a shaft portion 111, a cam contact portion 112, and a pressing portion 113.

A lever shaft 114 is spaced to the rear of the cam shaft 106 and is shaped like a cylinder extending to the left from the lower frame 32. The shaft portion 111 is shaped like a tube having an inner diameter greater than a diameter of the lever shaft 114 and is fitted around the lever shaft 114. Thus, the lever 103 is rotatably supported by the lever shaft 114.

The cam contact portion 112 extends to the front from the lever shaft 114 and faces the peripheral surface of the cam 102 from below. The lever 103 is urged, counterclockwise viewed from the left side, by the urging force of a helical torsion spring 110. Thus, the cam contact portion 112 is in elastic contact with the peripheral surface of the cam 102 from below. While the cam 102 rotates 360 degrees, the lever 103 moves or reciprocate between a force applying position P1 (indicated by an imaginary line of FIG. 7) where the cam contact portion 112 is pressed to its lowest position by the cam 102 and a force-free position P2 (indicated by a solid line of FIG. 7) where the cam contact portion 112 is closest to the cam shaft 106.

The pressing portion 113 is located to the right of the cam 102 and extends to the front from the lever shaft 114. The end of the pressing portion 113 integrally includes an end-contact portion 115 shaped like a cylinder protruding to each of the left and right sides. The end-contact portion 115 is an example of a second contact portion.

Figure 8:
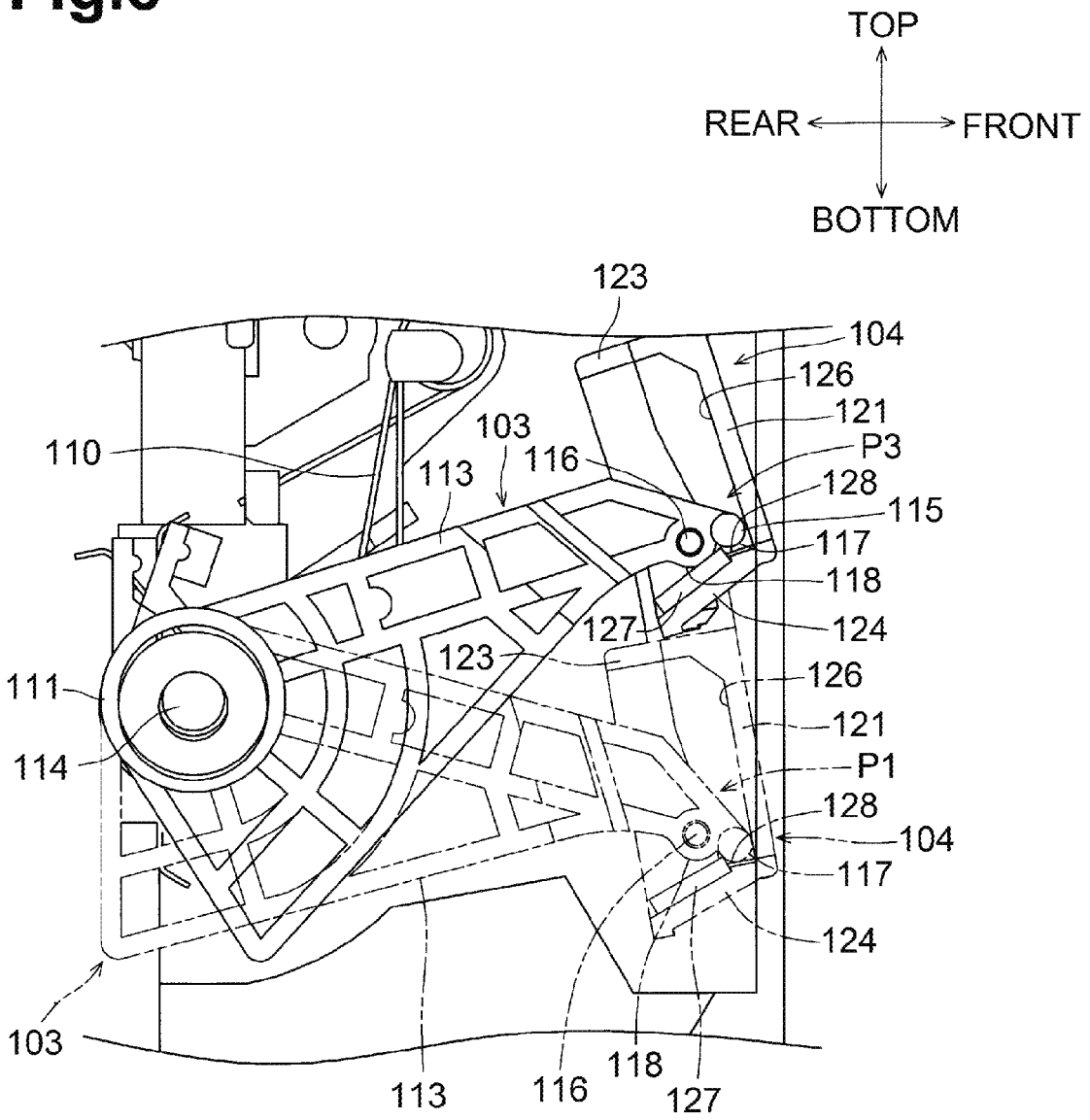
FIG. 8 is a sectional view of a lever and a force-releasing part included in the force-generating mechanism, wherein the lever is located at a force applying position and an initial contact position.

As illustrated in FIG. 8, the pressing portion 113 integrally includes a positioning portion 116, as an example of a positioning member 116. The positioning portion 116 is located proximate to the end-contact portion 115 of the pressing portion 113 and protrudes to each of the left and right sides of the pressing portion 113. The positioning portion 116 has a cylindrical peripheral surface.

Figure 9:
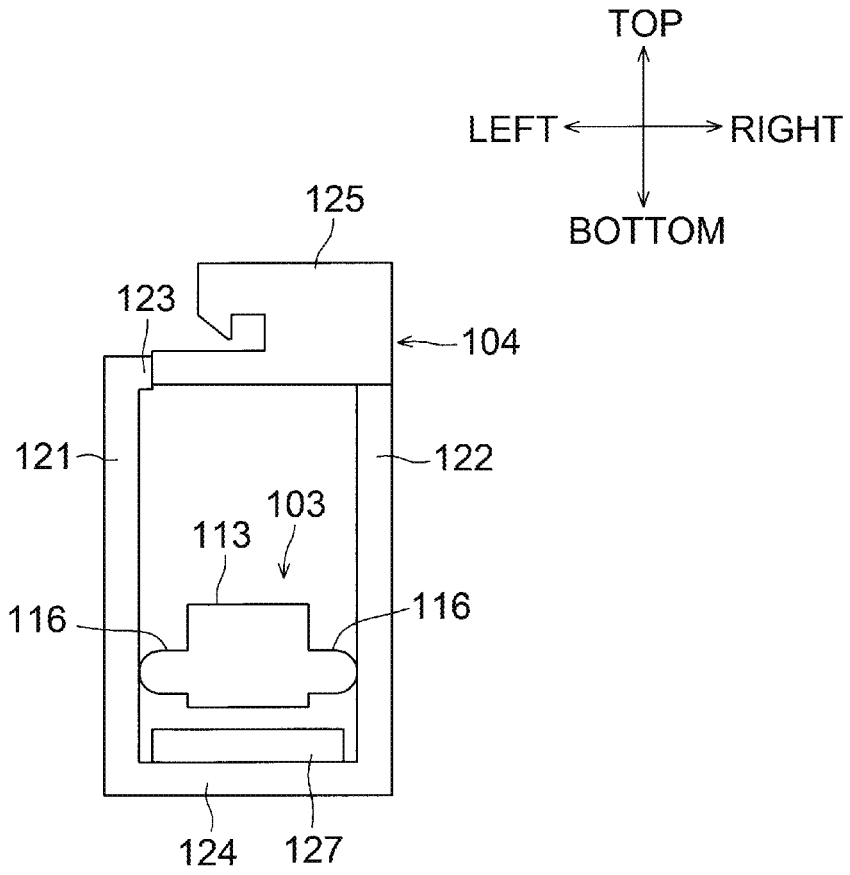
FIG. 9 is a sectional view of the lever and the force-releasing part.

The force-releasing part 104 is a molded part made from ABS resin. As illustrated in FIG. 9, the force-releasing part 104 includes opposite portions 121, 122 spaced apart from each other in the left-right direction to locate the positioning portion 116 therebetween, an upper connecting portion 123 connecting upper ends of the opposite portions 121, 122, a lower connecting portion 124 connecting lower ends of the opposite portion 121, 122, and a hook portion 125 formed on an upper surface of the upper connecting portion 123.

As illustrated in FIG. 8, the left opposite portion 121 has a guide hole 126 penetrating a front end portion of the opposite portion 121 in the left-right direction. Although not illustrated, the right opposite portion 122 also has a guide hole 126 penetrating a front end portion of the opposite portion 122 in the left-right direction. The guide holes 126 are identical in shape and extend vertically. As illustrated in FIG. 9, the pressing portion 113 of the lever 103 is located between the opposite portions 121, 122 of the force-releasing part 104. Left and right end-contact portions 115 of the pressing portion 113 are inserted into the guide holes 126 of the left and right opposite portions 121, 122, respectively. Left and right positioning portions 116 of the pressing portion 113 faces inner surfaces of the left and right opposite portions 121, 122, respectively. In other words, the left and right positioning portions 116 of the pressing portion 113 are in contact with the inner surfaces of the left and right opposite portions 121, 122. In this manner, the force-releasing part 104 is positioned in the left-right direction.

Each end-contact portion 115 has a peripheral surface 117 bulging toward the lower connecting portion 124 of the force-releasing part 104 relative to a lower surface of the pressing portion 113 (which faces downward when the lever 103 is located at the force applying position P1). The pressing portion 113 is formed with a bulging portion 118 as an example of a first contact portion. The bulging portion 118 is shaped like an arc along the peripheral surface of a corresponding positioning portion 116 and bulges toward the lower connecting portion 124 of the force-releasing part 104 relative to the lower surface of the pressing portion 113.

An upper surface of the lower connecting portion 124 is provided with a cushioning member 127. The cushioning member 127 is made from an elastic material such as rubber and is shaped like a plate. The cushioning member 127 is not provided at a front end portion 128, as an example of a pressed portion, of the upper surface of the lower connecting portion 124. The front end portion 128 is exposed.

As illustrated in FIG. 7, the force-transmission spring 105 is located between the input portion 57 of the arm 52 and the force-releasing part 104. An upper end of the force-transmission spring 105 is connected to the input portion 57 and a lower end of force-transmission spring 105 is connected to the hook portion 125 of the force-releasing part 104.

<Sheet Feeding Operation>

When no sheets S are fed from the MP tray 6, a lock pawl 132 of a second lock member 131, illustrated in FIG. 6, engages the teeth of the change gear 73. This engagement restricts counterclockwise rotation of the output gear 72 and the change gear 73 viewed from the left side. At this time, the solenoid 96 is turned off, and the lock pawl 93 of the first lock member 91 engages the engaging portion 82 of the sector gear 76, which in turn restricts clockwise rotation of the sector gear 76 viewed from the left side. The first missing teeth section 79 of the sector gear 76 faces the input gear 74 and thus the sector gear 76 and the input gear 74 disengage.

At this time, the lever 103 is located at the force-free position P2 illustrated in FIG. 7, and the end-contact portions 115 are spaced above the lower connecting portion 124 of the force-releasing part 104. Thus, the pressing mechanism 51 receives no external force, and the feed roller 35 contacts the feed-roller pad 38 or the upper surface of a sheet S supported on the MP tray 6 under an initial load, which is a load due to the weight of the roller unit 34 and the weight of the arm 52.

When a sheet S is fed from the MP tray 6 to the conveying path 27 (FIG. 2), the drive force from the motor is transmitted via the gear train 75 to the input gear 74, and the input gear 74 rotates counterclockwise viewed from the left side. While the lock pawl 132 of the second lock member 131 engages a tooth of the change gear 73, the input gear 74 rotates but the output gear 74 and the change gear 73 do not rotate. While the first missing teeth section 79 of the sector gear 76 faces the input gear 74, the input gear 74 rotates but the sector gear 76 does not rotate.

After that, the solenoid 96 is turned on, and the lock pawl 93 of the first lock member 91 disengages the engaging portion 82 of the sector gear 76. The sector gear 76 is urged by the helical torsion spring 81. When the lock pawl 93 disengages the engaging portion 82 and the restriction of rotation of the sector gear 76 is released, the sector gear 76 rotates clockwise viewed from the left side and starts to engage the input gear 74. The rotation of the input gear 74 is transmitted to the sector gear 76 and thus the sector gear 76 rotates clockwise viewed from the left side.

The cam 102 rotates together with the sector gear 76, which allows the lever 103 to move from the force-free position P2 toward the force applying position P1 and concurrently allows the pressing portion 113 of the lever 103 to move downward. With the movement of the pressing portion 113, the end-contact portions 115 of the pressing portion 113 move downward in the respective guide holes 126 of the force-releasing part 104.

As illustrated in FIG. 8, when the lever 103 rotates to an initial contact position P3 located between the force applying position P1 and the force-free position P2, the bulging portion 118 of the pressing portion 113 contacts the cushioning member 127 from above, and the cushioning member 127 is sandwiched in contact between the bulging portion 118 and the lower connecting portion 124 of the force-releasing part 104.

When the lever 103 further rotates from the initial contact position P3 toward the force applying position P1, the end-contact portion 115 of the pressing portion 113 contacts the front end portion 128 of the upper surface of the lower connecting portion 124. The end-contact portion 115 applies a downward force to the lower connecting portion 124, which causes the force-releasing part 104 to move downward. Concurrently with the movement of the force-generating part 104 by the downward force, the input portion 57 of the arm 52 is pulled downward via the force-transmission spring 105. Then, the downward force applied to the input portion 57 is transmitted from the arm 52 to the roller holder 37. The downward force transmitted to the roller holder 37 allows the roller unit 34 to pivot downward about the drive shaft 44. As a result, the feed roller 35 is pressed against the upper surface of the uppermost sheet S, which is supported on the MP tray 6, by a press contact force, which is the sum of the initial load and a load of the downward force transmitted to the roller holder 37.

The teeth of the change gear 73 and the lock pawl 132 of the second lock member 131 disengage at an appropriate timing. Thus, the change gear 73 is allowed to rotate, the drive force is transmitted to the input gear 74, and the output gear 72 and the change gear 73 rotate clockwise viewed from the left side. The rotation of the output gear 72 is transmitted from the output gear 72 to the drive gear 45, which causes the drive gear 45, the drive shaft 44, and the separation-roller gear 42 to rotate counterclockwise viewed from the left side. When the separation-roller gear 42 rotates, the rotation is transmitted via the idle gear 43 to the feed-roller gear 41, and the feed-roller gear 41 rotates counterclockwise viewed from the left side.

Concurrently with the rotation of the feed roller 35, at least the uppermost sheet S on the MP tray 6 is fed to the rear toward the conveying path 27. When some sheets S are supported on the MP tray 6, the upper most sheet S and a few subsequent sheets S may be fed together toward the conveying path 27. The fed sheets S are introduced into between the separation roller 36 and the separation pad 39, and only the uppermost sheet S is singly separated from the other sheets S. Thus, the single sheet S passes through between the separation roller 36 and the separation pad 39 and is fed to the conveying path 27.

When the sheet S is fed, the second missing teeth section 80 of the sector gear 76 faces the input gear 74 at a timing that the lever 103 starts to move from the force applying position P1 toward the force-free position P2, and thus the engagement of the input gear 74 with the sector gear 76 is released. When the engagement of the input gear 74 with the sector gear 76 is released, the urging force of the force-transmission spring 105 allows the lever 103 to move toward the upper position P2, which in turn causes the cam 102 to rotate clockwise viewed from the left side. When the cam 102 rotates, the sector gear 76 rotates and engages the input gear 74 again. Rotation of the input gear 74 allows the sector gear 76 to rotate. When the first missing teeth section 79 of the sector gear 76 faces the input gear 74, the engagement of the input gear 74 with the sector gear 76 is released again. Up to this point, the solenoid is switched on to off at an appropriate timing. The engaging portion 82 of the sector gear 76 contacts and engages the lock pawl 93 of the first lock member 91, which in turns restricts the rotation of the sector gear 76. Then, the teeth of the change gear 73 and the lock pawl 132 of the second lock member 131 engage again, which in turn restricts the rotation of the output gear 72 and the change gear 73.

This completes the operation for feeding a single sheet S.

<Operational Advantage>

As described above, the feed roller 35 is rotatably supported by the roller holder 37. The roller holder 37 is disposed at a position where it is contactable with the feed-roller pad 38 located at the front end portion of the upper surface of the lower frame 32, which constitutes an example of a tray together with the MP tray 6. The roller holder 37 is supported by the upper frame 33 pivotably about a pivot axis extending in a direction parallel to the rotation axis of the feed roller 35 or extending in the left-right direction. When a sheet S is supported on the MP tray 6, the feed roller 35 contacts the upper surface of the sheet S. As the feed roller 35 is in contact with a sheet S on the MP tray 6 regardless of whether the sheet S is fed or not fed, there is little likelihood that the feed roller 35 collides with the sheet S when the sheet S is fed, which reduces the occurrence of collision noise.

The lever 103 and the force-releasing part 104 are provided for transmission of a press contact force to the feed roller 35 and The lever 103 is pivotable about a pivot axis extending in a direction parallel to the rotation axis of the feed roller 35 or extending in the left-right direction between the force applying position P1 and the force-free position P2. The lever 103 includes the pressing portion configured to move downward concurrently with the pivotal movement from the force-free position P2 to the force applying position P1. The force-releasing part 104 is connected to the roller holder 37 via the arm 52 and the force-transmission spring 105. The force-releasing part 104 includes the lower connecting portion 124 to be pressed downward by the pressing portion 113 of the lever 103. When the lever 103 is located at the force applying position P1, the pressing portion 113 contacts the lower connecting portion 124 from above and applies a force to the lower connecting portion 124. When the lever 103 is located at the force-free position P2, the pressing portion 113 is spaced above the lower connecting portion 124.

When the lever 103 is located at the force applying position P1, the pressing portion 113 of the lever 103 contacts the front end portion 128 of the lower connecting portion 124 of the force-releasing part 104, the lever 103 applies a force to the force-releasing part 104, and the force is transmitted from the force-releasing part 104 to the roller holder 37. Then, the force is transmitted from the roller holder 37 to the feed roller 35, and the feed roller 35 contacts an upper surface of a sheet S supported on the MP tray 6 under the force transmitted to the feed roller 35 and its own weight. This reduces the feed roller 35 from slipping at the start of sheet feeding, and thus the feed roller 35 can feed a sheet S from the MP tray 6.

When the lever 103 moves from the force applying position P1 to the force-free position P2, the pressing portion 113 of the lever 103 is spaced apart from the lower connecting portion 124 of the force-releasing part 104, the force-releasing part 104 is released from the force or the force is not transmitted to the roller holder 37. Thus, when no sheets S are fed, the feed roller 35 can be prevented from receiving external force by locating the lever 103 at the force-free position P2, and the feed roller 35 can be in contact with the upper surface of the MP tray 6 or a sheet S supported on the MP tray 6 under its own weight. This structure allows the feed roller 35 to be raised by a leading end portion of a sheet S, which may be of low bending stiffness, to be supported on the MP tray 6 when the sheet S is inserted under the feed roller 35 along the upper surface of the MP tray 6. In other words, this structure facilitates setting of sheets S on the MP tray 6 and reduces inconvenience such as a wrinkle at the leading end portion of a sheet S to be set on the MP tray 6.

When the lever 103 is located at the force-releasing position P2, it may be separated from the force-releasing part 104. However, when the lever 103 is at the initial contact position P3 during movement from the force-releasing position P2 toward the force applying position P1, the cushioning member 127 is sandwiched between the force-releasing part 104 and the lever 103. Thus, there is little likelihood that the force-releasing part 104 collides with the lever 103, which reduces the occurrence of collision noise.

The cushioning member 127 is attached to the force-releasing part 104. The lever 103 includes the bulging portion 118 configured to contact the cushioning member 127 when the lever 103 is at the initial contact position P3, and the end-contact portions 115 configured to contact the front end portion 128 of the upper surface of the lower connecting portion 104 when the lever 103 is at the force applying position P1. When the lever 103 is at the force applying position P1, the cushioning member 127 is not sandwiched between the lever 103 and the force-releasing part 104. Thus, the lever 103 presses the force-releasing part 104 stably, which reduces variations in force to be transmitted from the lever 103 to the force-releasing part 104.

The bulging portion 118 is shaped like an arc bulging toward the cushioning member 127. The arc-shape allows the bulging portion 118 to be brought into contact with the cushioning member 127 with stability when the lever 103 is located at the initial contact position P3. Further, this shape prevents the bulging portion 118 from shaving the cushioning member 127 when the bulging portion 118 contacts the cushioning member 127, which can extend the useful life of the cushioning member 127. The larger the curvature of the bulging portion 118, a pressing force to be applied from the bulging portion 118 to the cushioning member 127 can be dispersed, and wear of the cushioning member 127 due to being pressed by the bulging portion 118 can be reduced.

Each end-contact portions 115 is shaped like an arc bulging toward the lower connecting portion 124 of the force-releasing part 104. Thus, each end-contact portion 115 and the lower connecting portion 124 can be brought into line contact with each other, which reduces variations in force transmitted from the lever 103 to the force-releasing part 104.

The lever 103 is made from POM and the force-releasing part 104 is made from ABS resin. POM is relatively lower in cost and more resistant to rubbing than ABS resin. Thus, the lever 103 made from POM is resistant to wear due to rubbing between the lever 103 and the cam 102. On the other hand, ABS resin has higher adhesiveness than POM. Thus, the cushioning member 127 can be easily and satisfactorily affixed to the force-releasing part 104 using double-faced tape.

The lever 103 integrally includes the positioning portions 116. The force-releasing part 104 includes the opposite portions 121, 122 facing the respective positioning portions 116 from outside the force-releasing part 104 in the left-right direction or sandwiching the positioning portions 116 therebetween. This positional relationship determines the position of the force-releasing part 104 in the left-right direction. As the positioning portions 116 are sandwiched between the opposite portions 121,122, the need to increase the physical size of the printer 2 in the left-right direction is reduced.

<Modifications>

While the illustrative embodiment of the disclosure has been described, the disclosure will be applicable to other embodiments.

Figure 10:
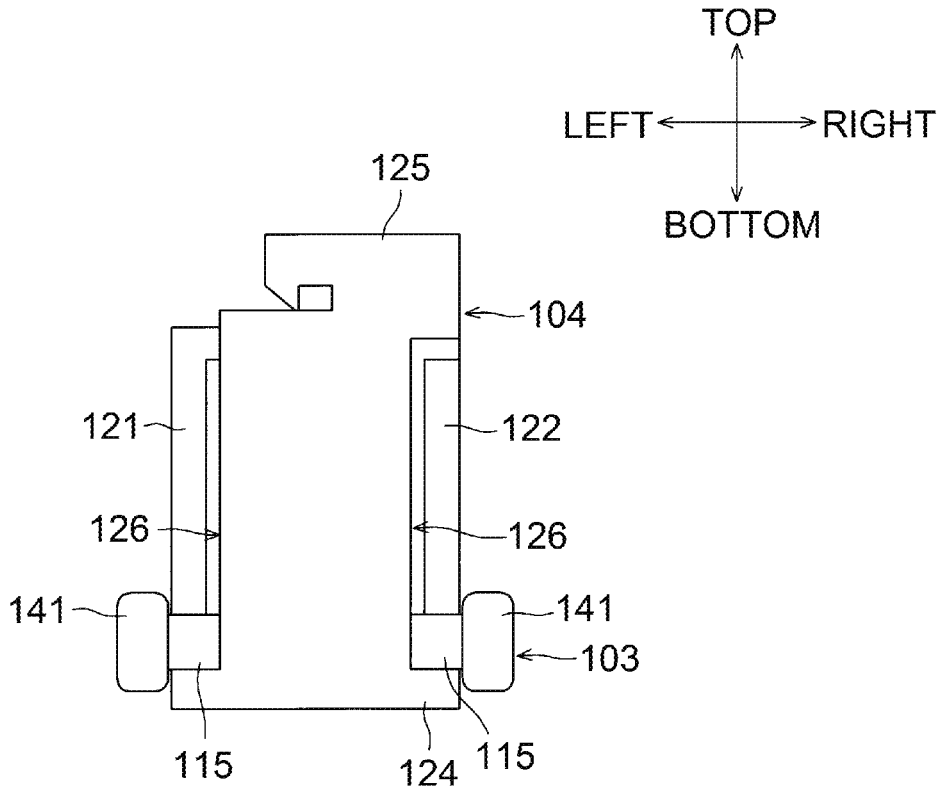
FIG. 10 is a sectional view of a modified force-releasing part.

The above embodiment illustrates that the opposite portions 121, 122 of the force-releasing part 104 face the respective positioning portions 116 of the lever 103 from outside the force-releasing part 104 in the left-right direction or sandwiching the positioning portions 116 therebetween, thereby the force-releasing part 104 is positioned in the left-right direction. Instead of this structure, a modified structure illustrated in FIG. 10 may be used. In the modified structure illustrated in FIG. 10, the lever 103 includes the left and right end-contact portions 115 protruding outward from the left and right guide holes 126 of the force-releasing part 104, respectively, and left and right positioning portions 141 attached to the left and right end-contact portions 115, respectively. The positioning portions 141 are wider in the front-rear direction than the respective guide holes 126, and the inner surfaces of the positioning portions 141 face the outer surfaces of the opposite portions 121, 122 in the left-right direction. This structure also determines the position of the force-releasing part 104 in the left-right direction.

Figure 11:
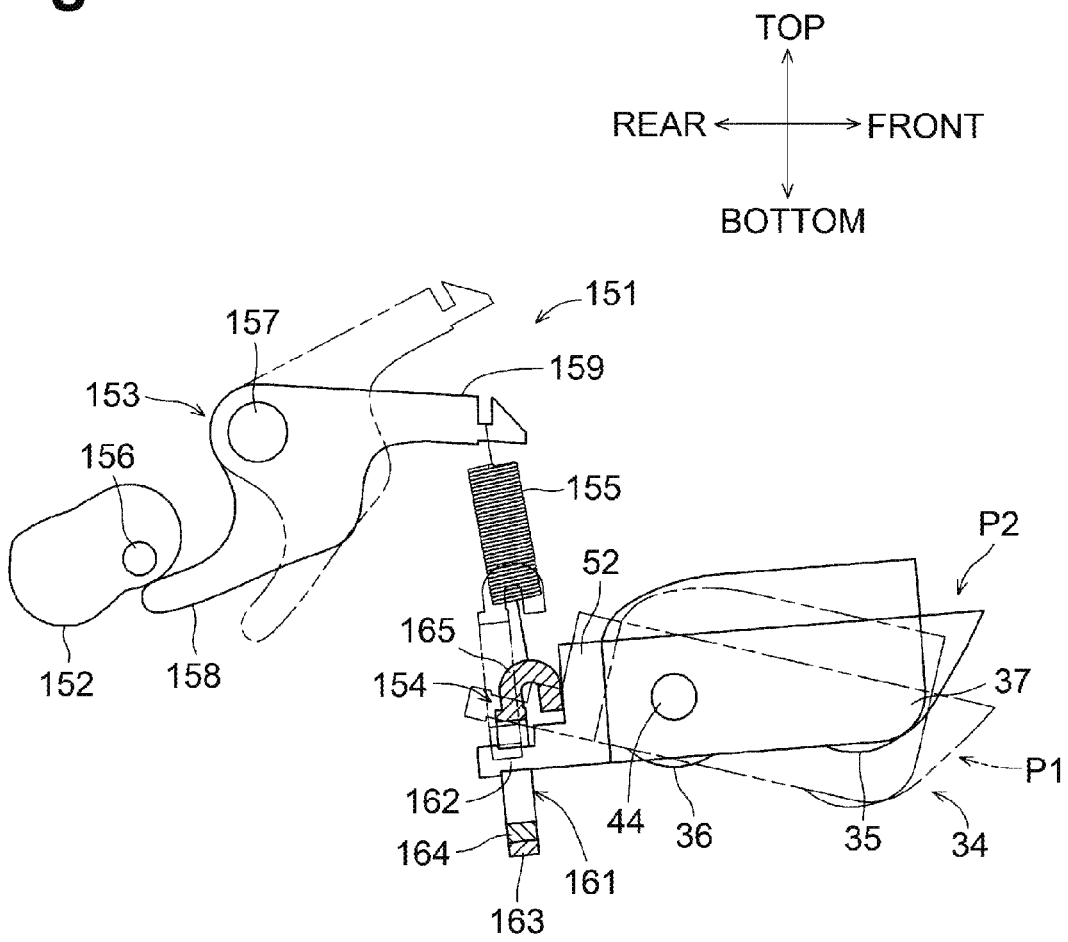
FIG. 11 is a sectional view of a modified force-generating mechanism.

Instead of the force-generating mechanism 101, a force-generating mechanism 151 illustrated in FIG. 11 may be used. The force-generating mechanism 151 includes a cam 152, a lever 153, a force-releasing part 154 as an example of a force-applying member, and a force-transmission spring 155. The force-generating mechanism 151 includes the arm 52, as an example of a force-transmitting device, extending to the left from the roller holder 37.

The cam 152 is fixed to a cam shaft 156, which is rotatable in synchronization with the sector gear 76 (FIG. 6). The cam shaft 156 receives rotation of a gear (not illustrated), which is rotatable integrally with the sector gear 76 via a gear train.

The lever 153 is a resin molded part made from polyacetal (POM). The lever 153 is pivotably supported by a lever shaft 157, which is located to the rear of and above the left end portion of the arm 52 and extends in the left-right direction. The lever 153 includes a cam contact portion 158 and an operation portion 159. The cam contact portion 158 extends from the lever shaft 157 downward to the rear and is configured to contact the peripheral surface of the cam 152 from below. The operation portion 159 extends from the lever shaft 157 toward the front above the left end portion of the arm 52.

The force-releasing part 154 is a molded part made from ABS resin. The force-releasing part 154 is shaped like a rectangular frame, and has a through-hole 161 penetrating the force-releasing part 154 in the front-rear direction and extending vertically. The force-releasing part 154 is located to the rear of a left end portion of the arm 52. A pressed portion 162 extending to the rear from the left end portion of the arm 52 is inserted through the through-hole 162 from the front side.

The force-releasing part 154 has a lower end portion 163 as an example of a pressing portion. The lower end portion 163 has an upper surface on which a cushioning member 164 is provided. The cushioning member 164 is made from an elastic material such as rubber and is shaped like a plate.

The force-transmission spring 155 is located between an operation portion 159 of the lever 153 and the force-releasing part 154. An upper end of the force-transmission spring 155 is connected to the operation portion 159 and a lower end of the force-transmission spring 155 is connected to a hook portion 165 formed at the upper end of the force-releasing part 154.

The lever 153 is urged, counterclockwise viewed from the left side, by the urging force of a helical torsion spring (not illustrated). Thus, the cam contact portion 158 of the lever 153 is in elastic contact with the peripheral surface of the cam 152 from below. While the cam 152 rotates 360 degrees, the lever 153 moves or reciprocate between a first position (indicated by an imaginary line of FIG. 11) where the cam contact portion 158 is pressed to its lowest position by the cam 102 and a second position (indicated by a solid line of FIG. 11) where the cam contact portion 158 is closest to the cam shaft 156.

The force-releasing part 154 reciprocates, during a reciprocating motion of the lever 153, between a force applying position P1 indicated by an imaginary line and a force-free position P2 indicated by a solid line. That is, when the lever 153 is at the second position, the force-releasing part 154 is located at the force-free position P2. At this time, the pressed portion 162 extending from the arm 52 is spaced above the lower end portion 163 of the force-releasing part 154. While the lever 153 moves from the second position toward the first position, the operation portion 159 of the lever 153 pulls the force-releasing part 154 upward via the force-transmission spring 155. While the force-releasing part 154 is pulled upward, the cushioning member 164 contacts the pressed portion 162 from below, and thus a load pulling the force-releasing part 154 upward is transmitted from the lower end portion 163 of the force-releasing part 104 to the pressed portion 162 extending from the arm 52 via the cushioning member 164. This load is transmitted from the arm 52 to the roller holder 37. As a result, the roller unit 34 pivots about the drive shaft 44 downward and the feed roller 35 is pressed against the upper surface of the uppermost sheet S, which is supported on the MP tray 6, by a press contact force, which is the sum of the initial load and the load transmitted to the roller holder 37. When the lever 153 reaches the first position, the force-releasing part 154 reaches the force applying position P1.

In this manner, the force-generating mechanism 151 also transmits the press contact force to the feed roller 35 or releases the feed roller 35 from the press contact force.

The cushioning member 164 is provided at the lower end portion 163 of the force-releasing part 154. The cushioning member 164, however, may be provided at a portion of the pressed portion 162, which is contactable with the lower end portion 163 of the force-releasing part 154.

The above embodiment (FIG. 8) illustrates the force-generating mechanism 101 in which the cushioning member 127 is provided on the lower connecting portion 124 of the force-releasing part 104. The cushioning member 127 may be provided at a portion of the pressing portion 113 of the lever 103 which is contactable with the lower connecting portion 124, that is, the bulging portion 118.

The above embodiment shows but is not limited to the printer 2 included in the MFP 1. The printer 2 may operate on a standalone basis.

The above embodiment shows but is not limited to the printer 2 which is a color laser printer. The disclosure is applicable to a monochrome laser printer that forms only monochrome images.

Illustrative embodiments described above are merely examples. Various changes, arrangements and modifications may be applied therein without departing from the spirit and scope of the disclosure.

What is claimed is:

1. A sheet feeding apparatus comprising:

a feed roller;

a roller holder supporting the feed roller rotatably about a rotation axis;

a frame supporting the roller holder pivotably about a first axis parallel to the rotation axis of the feed roller;

a force-transmitting device configured to transmit, to the roller holder, a force with which to cause the roller holder to pivot in a direction where the feed roller is pressed against a tray for supporting a sheet;

a force-applying member movable between a force applying position where the force-applying member contacts the force-transmitting device to apply the force thereto and a force-free position where the force-applying member is spaced apart from the force-transmitting device; and a cushioning member configured to, when the force-applying member is at an initial contact positon located between the force applying position and the force-free position, be sandwiched in contact between the force-transmitting device and the force-applying member.

2. The sheet feeding apparatus according to claim 1, wherein the force-applying member includes a lever pivotable about a second axis parallel to the rotation axis of the feed roller, the lever having a pressing portion configured to move downward along with movement from the force-free position to the force applying position, wherein the force-transmitting device includes a force-releasing part connected to the roller holder, the force-releasing part having a pressed portion configured to be pressed downward by the pressing portion, wherein, when the lever is at the force applying position, the pressing portion contacts the pressed portion from above to apply the force thereto, and wherein, when the lever is at the force-free position, the pressing portion is spaced above the pressed portion.

3. The sheet feeding according to claim 2, wherein the lever is made from polyacetal (POM), and wherein the force-releasing part is made from ABS resin.

4. The sheet feeding apparatus according to claim 2, further comprising a positioning member configured to position the force-releasing part in a direction parallel to the rotation axis of the feed roller.

5. The sheet feeding apparatus according to claim 4, wherein the positioning member is integrally formed with the lever.

6. The sheet feeding apparatus according to claim 5, wherein the force-releasing part includes opposite portions spaced apart from each other in the direction parallel to the rotation axis of the feed roller, the opposite portions sandwiching the positioning member therebetween.

7. The sheet feeding apparatus according to claim 1, wherein the force-transmitting device includes an arm located at a portion of the roller holder opposite the feed roller relative to the first axis of the roller holder, the arm extending in a direction parallel to the rotation axis of the feed roller, wherein the force-applying member includes a force-releasing part having a pressing portion, the pressing portion being configured to move upward along with movement from the force-free position to the force applying position, wherein, when the force-applying member is at the force applying position, the pressing portion contacts the arm from below to apply the force thereto, and wherein, when the force-applying member is at the force-free position, the pressing portion is spaced below the pressed portion.

8. The sheet feeding apparatus according to claim 1, wherein the cushioning member is attached to one of the force-transmitting device and the force-applying member, wherein the other one of the force-transmitting device and the force-applying member includes a first contact portion and a second contact portion, wherein, when the force-applying member is at the initial contact position, the first contact portion contacts the cushioning member, and wherein, when the force-applying member is at the force applying position, the second contact portion contacts one of the force-transmitting device and the force-applying member.

9. The sheet feeding apparatus according to claim 8, wherein the first contact portion is shaped like an arc bulging toward the cushioning member.

10. The sheet feeding apparatus according to claim 8, wherein the second contact portion is shaped like an arc bulging toward the one of the force-transmitting device and the force-applying member.

11. An image forming apparatus comprising:

a casing;

a tray pivotable between a closed position where the tray extends along a side of the casing and an open position where the tray is away from the side of the casing and configured to support a sheet thereon;

a sheet feeder configured to feed a sheet from the tray toward inside the casing: and an image forming device disposed in the casing and configured to form an image on the sheet fed by the sheet feeder, wherein the sheet feeder includes:

a feed roller;

a roller holder supporting the feed roller rotatably about a rotation axis;

a frame supporting the roller holder pivotably about a first axis parallel to the rotation axis of the feed roller;

a force-transmitting device configured to transmit, to the roller holder, a force with which to cause the roller holder to pivot in a direction where the feed roller is pressed against the tray;

a force-applying member movable between a force applying position where the force-applying member contacts the force-transmitting device to apply the force thereto and a force-free position where the force-applying member is spaced apart from the force-transmitting device; and a cushioning member configured to, when the force-applying member is at an initial contact positon located between the force applying position and the force-free position, be sandwiched in contact between the force-transmitting device and the force-applying member.

* * * * *